US007282670B2

(12) United States Patent
Matsubara et al.

(10) Patent No.: US 7,282,670 B2
(45) Date of Patent: Oct. 16, 2007

(54) CERAMIC HEATER AND GLOW PLUG HAVING THE SAME

(75) Inventors: Katsura Matsubara, Aichi (JP); Hiroki Watanabe, Aichi (JP); Masaya Ito, Aichi (JP)

(73) Assignee: NGK Spark Plug Co., Ltd., Nagoya (JP)

( * ) Notice: Subject to any disclaimer, the term of this patent is extended or adjusted under 35 U.S.C. 154(b) by 317 days.

(21) Appl. No.: 10/510,346

(22) PCT Filed: Apr. 28, 2003

(86) PCT No.: PCT/JP03/05428

§ 371 (c)(1),
(2), (4) Date: Jul. 19, 2005

(87) PCT Pub. No.: WO03/092330

PCT Pub. Date: Nov. 6, 2003

(65) Prior Publication Data

US 2005/0274707 A1 Dec. 15, 2005

(30) Foreign Application Priority Data

Apr. 26, 2002 (JP) ..... 2002-127305

(51) Int. Cl.
*F23Q 7/22* (2006.01)
*F23Q 7/00* (2006.01)

(52) U.S. Cl. ..... 219/270; 219/260

(58) Field of Classification Search ..... 219/270, 219/267, 538, 260, 261, 264
See application file for complete search history.

(56) References Cited

U.S. PATENT DOCUMENTS 5,364,608 A * 11/1994 Edler ..... 423/344
5,750,958 A * 5/1998 Okuda et al. ..... 219/267
6,328,913 B1 * 12/2001 Shaffer et al. ..... 252/500

(Continued)

FOREIGN PATENT DOCUMENTS

EP 1120998 1/2001

(Continued)

*Primary Examiner*—Daniel Robinson
(74) *Attorney, Agent, or Firm*—Morgan, Lewis & Bockius LLP

(57) ABSTRACT

The present invention relates to a ceramic heater which is capable of preventing an electric conduction defect of a heat-generating resistor from being caused by a supplied current, thus being excellent in voltage endurance, and a glow plug containing the ceramic heater. The ceramic heater 2 contained in the glow plug 1 has an insulative ceramic base material 21 and the heat-generating resistor 22 embedded in the insulative ceramic base material. The heat-generating resistor 22 has, as main components, an electrically conductive compound, silicon nitride and a grain boundary amorphous glass phase. The amount of the rare earth element contained in the heat-generating resistor is less than 2% by volume in terms of its oxide and, further, a molar ratio R=(A/A+B) of the mol number A of the amount of the rare earth element in terms of its oxide to a total of the mol number A and a mol number B, which is the amount of excess oxygen in terms of silicon dioxide, is 0.3 or less. By achieving such a constitution, the heat-generating resistor is capable of preventing electric conduction defects and of being excellent in voltage endurance.

9 Claims, 3 Drawing Sheets

U.S. PATENT DOCUMENTS

| | | | | |
|---|---|---|---|---|
| 6,359,261 | B1 * | 3/2002 | Watanabe et al. | 219/270 |
| 6,621,052 | B2 * | 9/2003 | Watanabe et al. | 219/270 |
| 6,933,471 | B2 * | 8/2005 | Hamel et al. | 219/270 |

FOREIGN PATENT DOCUMENTS

| | | |
|---|---|---|
| JP | 60-86787 | 5/1985 |
| JP | 63-88777 | 4/1988 |
| JP | 7-135097 | 5/1995 |
| JP | 8-45648 | 2/1996 |
| JP | 8-064346 | 3/1996 |
| JP | 10-050460 | 2/1998 |
| JP | 11-214124 | 8/1999 |
| JP | 2001-68257 | 3/2001 |
| JP | 2001-230060 | 8/2001 |

* cited by examiner

CERAMIC HEATER AND GLOW PLUG HAVING THE SAME

TECHNICAL FIELD

The present invention relates to ceramic heaters and glow plugs incorporating a ceramic heater. More specifically, the present invention relates to a ceramic heater excellent in voltage endurance and favorable for starting a diesel engine or the like and a glow plug provided with the heater.

BACKGROUND ART

Conventionally, in starting a diesel engine or the like, a sheathed heater in which a coil for generating heat embedded in insulating powder is provided in a bottomed cylindrical metallic sheath has been used. However, in the sheathed heater, since the coil for generating heat is embedded in insulating powder, thermal conductivity is low and a long period of time is needed for raising temperature. Therefore, in recent years, a ceramic heater which enhances thermal conductivity and is capable of rapid temperature rise through a structure embedding a heat-generating resistor comprising, as major components, an electrically conductive ceramic, such as tungsten carbide or molybdenum disilicide, and silicon nitride, in a base substance comprising insulative silicon nitride ceramic and which is excellent in corrosion resistance at high temperature has been developed. This ceramic heater is particularly used in a glow plug or the like in which temperature goes up to 1200° C. or more.

When a heat-generating resistor of the ceramic heater is produced, a rare earth oxide is added as a sintering additive to the electrically conductive ceramic and silicon nitride to form a grain boundary between an electrically conductive ceramic crystal phase and a silicon nitride crystal phase. When a glass phase having a low melting point is present in this grain boundary, durability and other properties of the ceramic heater are deteriorated. Then, ordinarily, a crystal phase such as a disilicate crystal phase ($RE_2Si_2O_7$; RE representing a rare earth element) or monosilicate crystal phase ($RE_2SiO_5$) is precipitated (for example, refer to JP-A No. 11-214124).

However, it is difficult to uniformly precipitate the crystal phase over the entire grain boundary of the heat-generating resistor and, accordingly, the crystal phase is precipitated only in a portion of the grain boundary and a component which did not contribute to crystallization remains as a glass phase. Namely, the grain boundary comes to have a locally uneven crystal structure. As a result, there are cases in which, when the ceramic heater was supplied with current, an electric conduction defect is generated in the heat-generating resistor, a rise of a resistance value of the heat-generating resistor easily occurs, and it comes to be impossible to raise the temperature up to a predetermined level.

An object of the present invention is to solve the conventional problems and to provide a ceramic heater which prevents electric conduction defects of a heat-generating resistor caused by supplied current, and is excellent in voltage endurance.

DISCLOSURE OF THE INVENTION

A ceramic heater according to the present invention, comprising an insulative ceramic base material and a heat-generating resistor embedded in the insulative ceramic base material, is characterized in that the heat-generating resistor comprises, as main components, silicon nitride, an electrically conductive compound and a grain boundary amorphous glass phase; a rare earth element contained in the heat-generating resistor in an proportion less than 2% mol in terms of its oxide ($RE_2O_3$; RE representing a rare earth element); and, when the mole number of the rare earth element in terms of its oxide is represented by A and the mole number of excess oxygen expressed in terms of silicon dioxide contained in the heat-generating resistor is represented by B, a value R computed from the following formula (1) is 0.3 or less:

$$R=A/(A+B) \quad (1)$$

Further, in the ceramic heater according to the present invention, the electrically conductive compound can be tungsten carbide or zirconium boride.

Still further, in the ceramic heater according to the present invention, the content of the electrically conductive compound in the heat-generating resistor can be from 20 to 30% by volume.

Even still further, in the ceramic heater according to the present invention, an oxide of the rare earth element can be $Er_2O_3$ and/or $Yb_2O_3$.

A glow plug according to the present invention is characterized by comprising the ceramic heater according to the present invention.

The "insulative ceramic base material" can be selected from among various types of insulative ceramic sintered body depending on the purpose. One example is an insulative ceramic base material comprising silicon nitride as the main component, which is sintered to form a silicon nitride sintered body. Here, the aforementioned "silicon nitride as the main component" means that the component which is present in the largest amount among all components in the silicon nitride sintered body is silicon nitride. More specifically, for example, when the entire weight of the insulative ceramic base material is defined as 100% by mass, silicon nitride can be 40% by mass or more, preferably 50% by mass or more, more preferably 60% by mass or more, still more preferably 70% by mass or more and particularly preferably 80% by mass or more. The silicon nitride sintered body may comprise a silicon nitride grain and a grain boundary amorphous glass phase and in addition to these components, there may be a crystal phase (for example, disilicate crystal phase) precipitated in the grain boundary. Further, the silicon nitride sintered body may contain aluminum nitride, alumina, sialon and the like.

The aforementioned "heat-generating resistor" means an electrically conductive ceramic which can be obtained by first adding a sintering additive containing a rare earth element to silicon nitride and an electrically conductive compound and, then, sintering the resultant mixture. This heat-generating resistor comprises, as main components, silicon nitride, an electrically conductive compound and a grain boundary amorphous glass phase, and is embedded in the insulative ceramic base material. Here, the aforementioned "main components" means components other than unavoidable impurities present only in the order of tens of ppm and a crystal phase which is present in such an extremely small amount that it can not ordinarily be detected by X-rays.

In the ceramic heater according to the present invention, the amount of the rare earth element contained in the heat-generating resistor is less than 2% mol in terms of its oxide, preferably 1.9% mol or less, more preferably 1.8% mol or less, still more preferably from 0.5 to 1.8% by mol and particularly from 0.8 to 1.8% mol. Here, the aforementioned "amount of rare earth element in terms of its oxide" means the amount of an oxide of a rare earth element ($RE_2O_3$) whose rare earth element component is equal to that contained in a heat-generating resistor. By making the amount of the rare earth element contained in the heat-generating resistor less than 2% mol in terms of its oxide, and thus causing the grain boundary of the heat-generating resistor to have a uniform crystal structure comprising the amorphous glass phase as a main component, the ceramic heater which is excellent in voltage endurance can be prepared. Further, in order to secure sinterability of the resistive heat-generating body, it is preferable that the amount of the rare earth element in terms of its oxide be 0.5% mol or more. In a case in which the amount of the rare earth element contained in the heat-generating resistor in terms of its oxide is 2% mol or more, the crystal phase is precipitated in the grain boundary existing between silicon nitride and the electrically conductive compound and then a locally uneven crystal structure is sometimes generated; therefore, this amount is not favorable. Particularly, it is preferable that the grain boundary of the heat-generating resistor is constituted only by the amorphous glass phase. A state in which the grain boundary of the heat-generating resistor is constituted only by the amorphous glass phase means that, when an X-ray diffraction measurement is performed by using a measuring apparatus and a measuring method to be described below, an X-ray diffraction spectrum of compounds other than silicon nitride and the electrically conductive compound do not appear.

In the heat-generating resistor, the grain boundary is formed between silicon nitride and the electrically conductive compound. When a glass phase having a low melting point is present in this grain boundary, durability and the like of the ceramic heater is deteriorated and, therefore, ordinarily, a crystal phase of disilicate crystal phase or the like is caused to precipitate. However, ordinarily, the crystal phase is precipitated only at a place at which a volume of a grain boundary phase is large, a grain boundary triple point or a multiple-grain boundary. In places other than these, namely double-grain boundaries, the thickness of the grain boundary phase is extremely small, on the order of several nm, making it difficult for the crystal phase to form. For this account, only a portion of the grain boundary phase is formed and the amorphous glass phase derived from the rare earth element which did not contribute to crystallization comes to be present in other portions. For this account, the grain boundary has a locally uneven crystalline structure, which sometimes deteriorates the voltage endurance.

On the other hand, in the ceramic heater according to the present invention, by making the amount of the rare earth element contained in the heat-generating resistor to be less than 2% mol in terms of its oxide and, accordingly, causing the grain boundary of the heat-generating resistor to have a uniform crystal structure comprising the amorphous glass phase as the main component, a ceramic heater excellent in voltage endurance can be prepared.

Further, in the ceramic heater according to the present invention, when the mole number of the rare earth element in terms of its oxide is represented by A and the mole number of excess oxygen contained in the heat-generating resistor expressed in terms of silicon dioxide is represented by B, the value R to be computed by the aforementioned formula (1) is 0.3 or less, preferably 0.25 or less and more preferably 0.22 or less. By controlling the mole percentage to be the values above, even though the grain boundary phase has the amorphous glass phase as a main component, a ceramic heater excellent in voltage endurance can be prepared. Where R is over 0.3, supplied current flowing through the heat-generating resistor causes local breakages in the heat-generating resistor forming air spaces or the like, and, as a result, a rise of the resistance value of the heat-generating resistor tends to occur, and it comes to be impossible to raise the temperature up to the predetermined temperature; therefore, this R value is not favorable. Now, the aforementioned "air space" means a hollow portion in a hole shape formed in the heat-generating resistor (see FIG. 3). However, where the value R is 0.1 or more, sintering of the heat-generating resistor is sufficiently performed; therefore, this value is favorable. For this reason, the value R is 0.1 or more, preferably 0.15 or more and particularly preferably 0.2 or more. Namely, the value R is preferably in the range of from 0.1 to 0.3 and more preferably in the range of from 0.15 to 0.3.

Further, the aforementioned "excess oxygen" means oxygen left after the amount of oxygen in the rare earth oxide thereof is subtracted from an entire amount of oxygen contained in the heat-generating resistor. Further the aforementioned "the amount of excess oxygen in terms of silicon oxide" means the amount of silicon dioxide ($SiO_2$) converted from the amount of the aforementioned excess oxygen.

The electrically conductive compound is not limited to any particular type, as long as it is a compound having conductivity. Examples of such electrically conductive compounds include electrically conductive inorganic compounds such as carbides, borides, silicides and the like of metals belonging to the 4*a*, 5*a*, and 6*a* groups, for example tungsten carbide and zirconium boride. These compounds may either be used individually of in any combination thereof. Tungsten carbide and zirconium boride have a smaller thermal expansion coefficient than that of titanium nitride, molybdenum silicide or the like. Therefore, when tungsten carbide or zirconium boride is used as the electrically conductive compound, the difference in thermal expansion coefficient between the heat-generating resistor and the insulative ceramic base material, particularly, an insulative ceramic base material comprising silicon nitride as a main component, can be small and accordingly, the voltage endurance can further be improved.

Furthermore, the content of the electrically conductive compound is not particularly limited but it is preferably from 20 to 30% by volume, where the volume of the heat-generating resistor is 100%. Where the content of the heat-generating resistor is 20% by volume or more, the number of conductive paths in the heat-generating resistor is increased and, thus electric conduction defects are prevented; therefore, this amount is favorable. In a case in which the content of the heat-generating resistor is 30% by volume or less, the thermal expansion/contraction of the heat-generating resistor is decreased and, accordingly, the difference in thermal expansion between the insulative ceramic base material and the heat-generating resistor becomes small. As a result, if the ceramic heater repeats a cycle of heat-generation and cooling, cracks caused by thermal fatigue in the heat-generating resistor do not readily occur, and accordingly, electric conduction defects are prevented; therefore, this case is favorable. Particularly, when the cross-sectional area of the ceramic heater is from 3 to 20 $mm^2$ in a direction orthogonal to the longitudinal direction of the ceramic heater and the cross-sectional area of the ceramic heater is 0.07 to 0.8 $mm^2$ in a direction orthogonal to a current supply direction, cracks tends to be generated. For this reason, it is particularly preferable that the above tungsten carbide or zirconium boride is used as the electrically conductive compound, and further that the content thereof is 20 to 30% by volume. Here, "crack" means a crack that traverses the resistive heat-generating body (see FIG. 4).

The aforementioned rare earth elements can either be used individually or in any combination thereof. For example, Sc, Y, La, Ce, Pr, Nd, Gd, Tb, Dy, Er, Yb or Lu, or combinations thereof can be used. Further, as for a specific example of these rare earth elements, Er and/or Yb (when expressed by oxides thereof, $Er_2O_3$ and/or $Yb_2O_3$) can be mentioned.

Further, the ceramic heater according to the present invention can be provided with a lead wire for supplying current to the heat-generating resistor embedded in the insulative ceramic base material form outside. Also, the production method for the ceramic heater according to the present invention is not particularly limited and any method can arbitrarily be selected.

BEST MODE FOR CARRYING OUT THE INVENTION

A ceramic heater and a glow plug according to the present invention are explained in detail with reference to FIGS. 1 and 2.

1. Constitution of Ceramic Heater and Glow Plug

Figure 1:
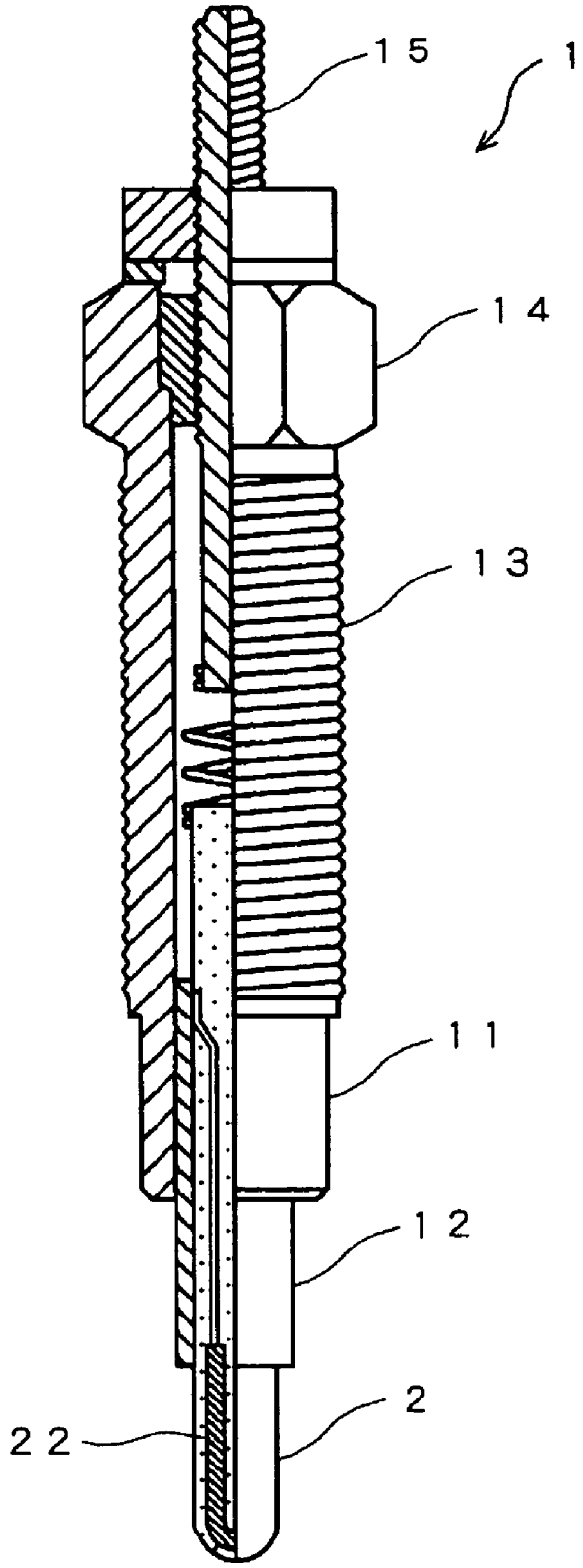
FIG. 1 is a schematic cross-sectional diagram for explaining a glow plug according to the present invention provided with a ceramic heater according to the present invention.
Figure 2:
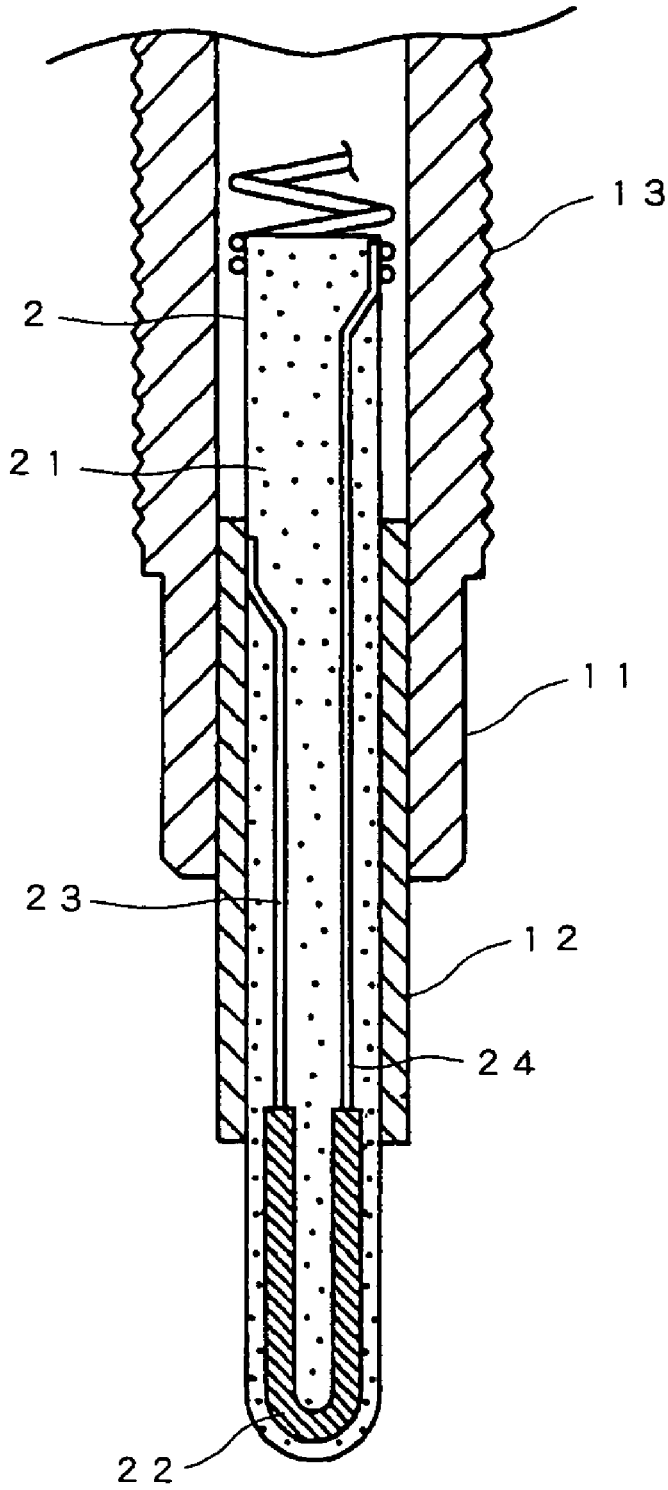
FIG. 2 is a partially enlarged cross-sectional diagram for explaining a ceramic heater portion of a glow plug according to the present invention.

As shown in FIGS. 1 and 2, a glow plug 2 according to the present invention provided with a ceramic heater according to the present invention comprises a cylindrical outer cylinder 12 extending in a direction along the axis of the glow plug, a cylindrical metallic fitting 11 positioned at the rear end (upper side in FIG. 1) of the outer cylinder 12 in a direction along the axial line thereof for holding an rear portion of the outer cylinder, a ceramic heater 2 inserted in the outer cylinder 12 and a terminal electrode 15 arranged at the rear end of the metallic fitting 11 and along the axis of the glow plug in an insulative state.

The outer cylinder 12 is made of a metal having a thermal resistance and the outer circumferential face of its rear portion (rear portion of the outer cylinder) is brazed to the inner circumferential face of the front end of the metallic fitting 11. The metallic fitting 11 is made of carbon steel and, at the rear end thereof in a direction along the axial line thereof, a hexagonal portion 14 for coupling with a wrench is formed. Further, on the outer circumferential face in front of the hexagonal portion 14 in a direction along the axial line thereof, formed is a male screw 13 fixing the glow plug to a combustion chamber of a diesel engine by screwing.

As shown in FIG. 2, in the ceramic heater 2, a heat-generating resistor 22 and a lead wires 23 and 24 are embedded in a base material 21 made of silicon nitride ceramic. The heat-generating resistor 22 is a U-shaped rod.

The lead wires 23 and 24 are each a wire made of tungsten having a diameter of 0.3 mm. Ends of these wires are connected to the ends of the heat-generating resistor 22, and the other ends of these wires are exposed on the outer circumferential face of the base material 21, one at the middle and one at the rear end of the base material 21. Further, the material for these lead wires 23 and 24 may be other than tungsten, as long as it has a lower resistance than that of the heat-generating resistor. Suitable materials for the lead wires 23 and 24, include a composite of silicon nitride and tungsten carbide and a material comprising, as the main components, tungsten carbide, molybdenum silicide and the like.

2. Production Method for Ceramic Heater and Glow Plug

In accordance with the method described below, Samples 1 to 15 of the ceramic heater 2 as shown in Tables 1 and 2 below were produced. Thereafter, glow plugs provided with respective Samples 1 to 15 of the ceramic heater 2 as shown in Tables 1 and 2 were produced. An asterisk mark "*" as shown in Tables 1 and 2 indicates Comparative Examples.

(1) Preparation of Unfired Heat-generating Resistor

Tungsten carbide, zirconium boride, titanium nitride and molybdenum disilicide each having an average grain diameter of from 0.5 to 1.0 μm, silicon nitride having an average grain diameter of from 0.5 to 20 μm, and sintering additive having an average grain diameter of about 1.0 μm were weighed such that they have respective ratios as shown in Tables 1 and 2 and, then, mixed together for 40 hours in a ball mill in a wet state, thereby obtaining mixtures. For the sintering additive, $Er_2O_3$ and $Yb_2O_3$ were selected and used.

Subsequently, the thus-obtained mixture was dried by a spray dry method, to prepare granulated powder.

A binder was added to the thus-prepared granulated powder at a proportion of 40 to 60% by volume and kneaded for 10 hours in a kneader. For the binder, a tactic polypropylene, microcrystalline wax and an ethylene-vinyl acetate copolymer can be used. Also, a plasticizer or a lubricant can optionally be added.

Thereafter, the resultant kneaded mixture was processed with a pelletizer to produce a grains having a size of about 3 mm.

Further, lead wires 23 and 24 were arranged at respective predetermined positions in an injection molding die, the produced grains were filled in a molding injection device and the grains were injected, to thereby form an unfired heat-generating resistor into which ends of the lead wires 23 and 24 were connected.

(2) Preparation of Ceramic Heater

Silicon nitride having an average grain diameter of 1.0 μm, a sintering additive, and an additive were weighed such that they have respective ratios as shown in Tables 1 and 2, they were mixed together in a ball mill in a wet state, to the resultant mixture was added a binder, and a powder mixture was obtained by a spray-dry method. For the sintering additive, a combination of $Er_2O_3$, $V_2O_5$, $WO_3$, $Yb_2O_3$, $SiO_2$ and $Cr_2O_3$ was used. For the additive, a combination of $MoSi_2$, $CrSi_2$ and SiC was used.

Subsequently, the unfired heat-generating resistor was embedded in the thus-obtained mixed powder and subjected to press-molding, to thereby obtain a formed body which becomes a sintered base material. Thereafter, the thus-obtained formed body was dewaxed for one hour in an atmosphere of nitrogen at 800° C. and, then, sintered by a hot-press method, for 90 hours at a temperature of 1750° C. and under a pressure of 24 MPa, to thereby obtain a sintered body. On this occasion, the cooling rate until the sintered body reached 1400° C. was set to be 10° C./min. or more.

The thus-obtained sintered body was properly formed by grinding so as not only to be in a rod shape having a diameter of 3.5 mm but also to expose the other end of each of the lead wires 23 and 24 on the surface thereof, to thereby obtain a ceramic heater 2.

(3) Preparation of Glow Plug

After an outer cylinder 12 was brazed on an outer circumferential face of the thus-obtained ceramic heater 2, a rear portion of the outer cylinder was inserted into the front end of a metallic fitting 11 along its axis and, then, silver brazed. Further, a terminal electrode 15 was fixed to a rear end side of the metallic fitting 11 by an insulator and a nut, to thereby obtain a glow plug 1.

3. Measurement of Various Types of Analysis Parameters

Regarding the heat-generating resistor in each of ceramic heaters of Samples 1 to 15 as shown in Tables 1 and 2, the amount (% by mol) of contained rare earth element in terms of the oxide thereof, the value R (ratio of mol numbers $[RE_2O_3/(RE_2O_3+SiO_2)]$), and the content (% by volume) of the electrically conductive compound were measured. The results are shown in Tables 1 and 2.

The amount of the rare earth element in terms of its oxide was computed by the following method. Firstly, a ceramic heater was cut in halves along the plane on which a cross-sectional face of a heat-generating resistor appeared and, then, a surface of the exposed heat-generating resistor was subjected to analysis by using an energy dispersive X-ray analyzer (trade name: EX-23000BU; available from Nippon Denshi K.K.) to obtain the mass ratio of the rare earth element in the heat-generating resistor. Next, a mass ratio of the rare earth element in terms of its oxide ($RE_2O_3$) was computed as a value of the oxide of the rare earth element converted from the thus-obtained mass ratio of the rare earth element, to thereby obtain the amount (% by mol) of the rare earth element in terms of its oxide.

Further, the value R in the aforementioned formula (1) was computed by a method as described below. Firstly, the heat-generating resistor alone was obtained by scraping the ceramic heater and, then, crushed and, thereafter, subjected to analysis by using an oxygen-nitrogen analyzer (trade name: EMGA-650; available from Horiba, Ltd.), to thereby obtain an entire amount of oxygen present in the heat-generating resistor. Next, another ceramic heater which has been prepared with same composition and under same condition as those of the ceramic heater from which the oxygen amount was obtained was cut in halves along a plane on which a cross-sectional face of the heat-generating resistor appeared. Thereafter, the thus-appeared surface of the heat-generating resistor was subjected to analysis by using the energy dispersive X-ray analyzer (trade name: EX-23000BU; available from Nihon Denshi K.K.), to thereby obtain the mass ratio of the rare earth element present in the heat-generating resistor. Next, the mass ratio of the rare earth element in terms of its oxide ($RE_2O_3$) was computed as a value of the oxide of the rare earth element converted from the thus-obtained mass ratio of the rare earth element, to thereby obtain the amount (% by mol) of the rare earth element in terms of its oxide. Further, the mass ratio of the aforementioned excess oxygen in terms of silicon dioxide ($SiO_2$) was computed by subtracting the oxygen amount corresponding to the amount of the rare earth oxide from the mass ratio of the entire oxygen amount present in the heat-generating resistor and, then, converting the remaining oxygen amount to that of silicon dioxide ($SiO_2$).

In the manner described above, the mass proportions of the calculated amount of the oxide ($RE_2O_3$) of the rare earth element and the calculated amount of silicon dioxide ($SiO_2$) present in the heat-generating resistor can be computed, then, based on the thus-computed mass proportions, respective mol numbers A and B of the $RE_2O_3$ and $SiO_2$ in the heat-generating resistor were computed. Thereafter, based on the thus-computed mol numbers A and B of the $RE_2O_3$ and $SiO_2$, the value R in the formula (1) was determined.

Further, the content (% by volume) of the electrically conductive compound was computed by a method as described below. A ceramic heater was cut in halves along the plane on which a cross-sectional face of a heat-generating resistor appeared and, then, the exposed surface of the heat-generating resistor was subjected to mirror finishing by using a mirror-polishing machine (trade name: REFINE POLISHER; available from Refine Tec, Ltd.). The thus-mirror finished surface was subjected to analysis by using an electron beam probe microanalyzer (trade name: JXA8800M; available from Nippon Denshi K.K.) with a viewing field of ×200 magnification. Specifically, the area ratio of regions detected to have a high content of electrically conductive substances (tungsten, zirconium, titanium and molybdenum) in the viewing field was computed and, then, content (% by volume) of the electrically conductive compounds in the heat-generating resistor was determined.

Further, respective heat-generating resistors in the ceramic heaters of Samples 1 to 15 as shown in Tables 1 and 2 were subjected to analysis by using an X-ray diffraction apparatus (main part: trade name: ROTORFLEX; available from Rigaku Corporation; control part: trade name: RINT2000; available from Rigaku Corporation) under following conditions:

X-ray supply: Cu K-α1/40 kV/100 mA;
divergence slit: 1 deg;
scattering slit: 1 deg;
receiver slit: 0.3 mm;
scanning speed: 10 deg/min.;
scanning step: 0.02 deg; and
2θ: 10 to 70 deg.

It was found that, in all Samples, an X-ray diffraction spectrum was not observed except for silicon nitride and the electrically conductive compounds and, accordingly, a grain boundary comprises only an amorphous glass phase.

4. Voltage Endurance Test

A durability test was conducted by using glow plugs provided with ceramic heaters of Samples 1 to 15 as shown in Tables 1 and 2 given below.

In this voltage endurance test, a cycle in which voltage was applied so that in an open room of room temperature, the maximum temperature of the ceramic heater 2 became 1350° C., current was supplied for one minute and, subsequently, current was stopped for 30 seconds, was repeated 150,000 times (namely, 150,000 cycles). During such repetition, resistance value of the ceramic heater was simultaneously measured. In the case in which the thus-measured resistance value came to be over a predetermined value greater than the initial resistance value, it was determined that an electric conduction defect had occurred and, then, the number of cycles at that time was defined as the value of voltage endurance. The results are shown in Tables 1 and 2. Further, the term ">150000" as shown in Tables 1 and 2 means that the resistance value of the heat-generating resistor which has been subjected to 150000 cycles remained within the predetermined range. Still further, judgment criterion of the voltage endurance was set as follows:

OO: The cycle number in electric conduction was 150000 cycles or more;

O: The cycle number was from 10000 cycles to less than 150000 cycles; and

X: The cycle number was less than 10000 cycles.

Figure 3:
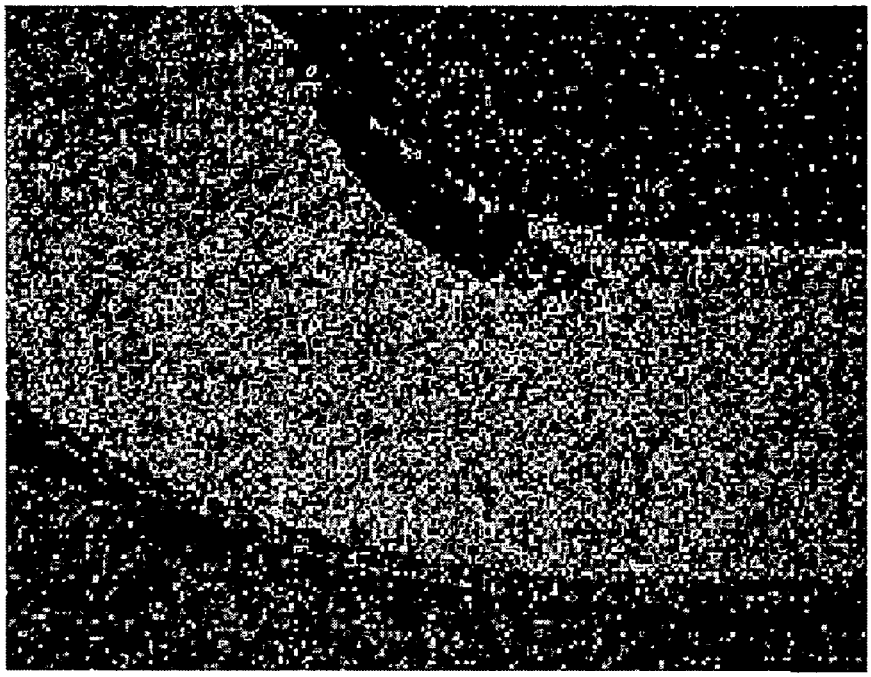
FIG. 3 is a copy of an optical microscopic image showing an example of an air space generated in a heat-generating resistor.
Figure 4:
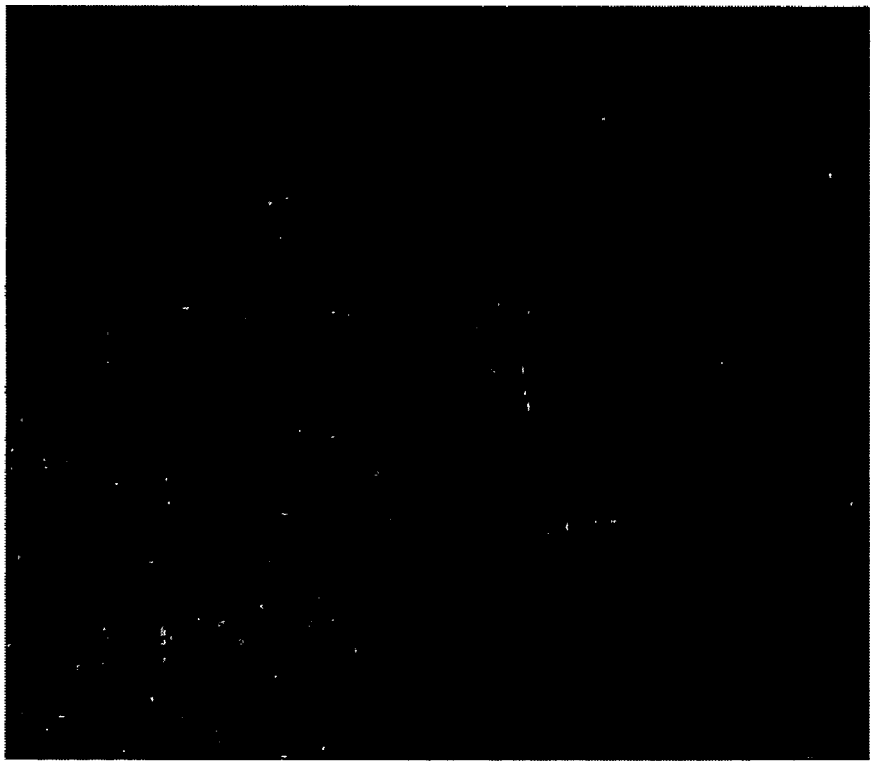
FIG. 4 is a copy of an optical microscopic image showing an example of a crack generated in a heat-generating resistor.

Further, when the durability of the ceramic heater 2 is insufficient, an electric conduction defect occurs in the heat-generating resistor 22, an air space or a crack is generated in the heat-generating resistor 22 and the resistance value thereof is increased. Thus, in each of Samples 1 to 15 after being subjected to the voltage endurance test, the ceramic heater 2 was cut in a longitudinal direction along a plane on which a sectional face thereof appeared and, then, the cross-sectional face was polished and, thereafter, the thus-polished cross-sectional face was observed by an optical microscope, to thereby judge presence or absence of electric conduction defect (presence or absence of an air space or a crack). Specifically, when the cross-sectional face of the heat-generating resistor was observed using an optical microscope (trade name: STEREOSCOPIC MICROSCOPE SMC-1500; available from Nikon Corporation), presence or absence of generation of the air space holes as shown in FIG. 3 or presence or absence of generation of the cracks traversing the heat-generating resistor as shown in FIG. 4 was observed. Presence or absence of such electric conduction defects is shown in Tables 1 and 2.

TABLE 1

| Sample | 1 | 2 | 3 | *4 | *5 | *6 | *7 |
|---|---|---|---|---|---|---|---|
| Base material weight ratio | | | | | | | |
| $Si_3N_4$ | | | | 85 | | | |
| $Er_2O_3$ | | | | 9 | | | |
| $V_2O_5$ | | | | 1 | | | |
| $WO_3$ | | | | 2 | | | |
| $MoSi_2$ | | | | 3 | | | |
| Heat generating resistor weight ratio | | | | | | | |
| WC | 55 | 63.35 | 67.31 | 60.75 | 61.46 | 61.4 | 60.75 |
| $Si_3N_4$ | 40.05 | 31.21 | 27.42 | 32.71 | 33.1 | 30.6 | 34.25 |
| $Er_2O_3$ | 4 | 3.94 | 3.75 | — | 4.94 | 6.1 | 4.3 |
| $Yb_2O_3$ | — | — | — | 5.61 | — | — | — |
| $SiO_2$ | 0.95 | 1.5 | 1.52 | 0.93 | 0.5 | 1.9 | 0.7 |
| Amount of rare earth element in terms of oxide (mol %) | 1.75 | 1.75 | 1.69 | 2.47 | 2.23 | 2.73 | 1.92 |
| Value R | 0.29 | 0.21 | 0.23 | 0.33 | 0.37 | 0.28 | 0.31 |
| Content of electrically conductive compound (vol %) | 20.6 | 27.0 | 30.7 | 25.5 | 25.8 | 26.0 | 25.0 |
| Electric cycle (times) | >150000 | >150000 | 122500 | 4300 | 27300 | 32700 | 18600 |
| Judgment of voltage endurance | OO | OO | O | X | X | X | X |
| Presence or absence of air space | Absence | Absence | Absence | Presence | Presence | Presence | Presence |
| Presence or absence of crack | Absence | Absence | Presence | Presence | Presence | Presence | Presence |

TABLE 2

| Sample | 8 | 9 | *10 | *11 | 12 | 13 | 14 | *15 |
|---|---|---|---|---|---|---|---|---|
| Base material weight ratio | | | | | | | | |
| $Si_3N_4$ | | | 66 | | | 64 | | |
| $Yb_2O_3$ | | | 21.5 | | | 24 | | |
| $SiO_2$ | | | 1.5 | | | 2 | | |
| $Cr_2O_3$ | | | 1 | | | — | | |
| $CrSi_2$ | | | 8 | | | 8 | | |
| SiC | | | 2 | | | 2 | | |
| Heat generating resistor weight ratio | | | | | | | | |
| WC | 69.4 | 65.24 | 58.03 | 65.09 | — | — | — | — |
| $ZrB_2$ | — | — | — | — | 37.3 | — | — | 40.75 |
| TiN | — | — | — | — | — | 32.81 | — | — |
| $MoSi_2$ | — | — | — | — | — | — | 40.2 | — |
| $Si_3N_4$ | 26.99 | 29.32 | 31.25 | 29.25 | 57.1 | 62.19 | 53.8 | 50.85 |
| $Yb_2O_3$ | 2.89 | 3.94 | 8.93 | 4.72 | 4.2 | 3.95 | 4.5 | 7.4 |
| $SiO_2$ | 0.72 | 1.5 | 1.79 | 0.94 | 1.4 | 1.35 | 1.5 | 1 |
| Amount of rare earth element in terms of oxide (mol %) | 1.29 | 1.71 | 3.92 | 2.08 | 1.37 | 0.99 | 1.65 | 2.45 |
| Value R | 0.28 | 0.22 | 0.35 | 0.31 | 0.22 | 0.21 | 0.23 | 0.39 |
| Content of electrically conductive compound (vol %) | 32.6 | 28.8 | 24.2 | 29.0 | 24.5 | 22.6 | 23.5 | 28.1 |
| Electric cycle (times) | 147500 | >150000 | 10000 | 83700 | >150000 | 121400 | 105300 | 2850 |
| Evaluation of voltage endurance | O | OO | X | X | OO | O | O | X |
| Air spaces | Absent | Absent | Present | Present | Absent | Absent | Absent | Present |
| Cracks | Present | Absent | Absent | Absent | Absent | Present | Present | Present |

5. Result of Voltage Endurance Test

As shown in Tables 1 and 2, in the ceramic heater of each of Samples 1 to 3, 8 to 10, and 12 to 14 in which the amount of the rare earth element in terms of its oxide contained in the heat-generating resistor was less than 2% mol and the aforementioned value R was 0.3 or less, the resistance value of the heat-generating resistor remained within the allowable range even though it was subjected to the electric cycle 100000 times and further, the air space of the like was not observed. Based on these findings, it has been found that the ceramic heater according to the present invention did not generate an electric conduction defect during an ordinary service period of the glow plug and, accordingly, is excellent in voltage endurance. Particularly, in the ceramic heater of each of Samples 1, 2, 9 and 12 in which the electrically conductive compound contained in the heat-generating resistor is tungsten carbide or zirconium boride and a content thereof is from 20 to 30% by volume, it has been found that the resistance value of the ceramic heater remains within the allowable range even though it was subjected to the electric cycle 150000 times, showing that the ceramic heater is excellent in the voltage endurance.

On the other hand, the ceramic heater of each of Samples 4 to 7, 10, 11 and 15 came to be in a circuit-breakage state before the electric cycle reached 10000 repetitions. Further, when the cross-sectional face of the heat-generating resistor was observed, air spaces were observed and, accordingly, it was clear that an electric conduction defect occurred.

Based on these findings, for the ceramic heater in which the heat-generating resistor comprising a composite material comprising a silicon nitride base material, silicon nitride and tungsten carbide or zirconium boride and thus having electric conductivity is embedded, it is considered important that the content of the rare earth element in the heat-generating resistor be made small so as not only to cause the grain boundary phase to have a uniform crystalline structure comprising an amorphous glass phase but also to control the aforementioned value R to be within a specified range or lower.

The reason why the ceramic heater is excellent in the voltage endurance when the aforementioned value R is within the specified range even though the grain boundary phase is an amorphous glass phase is surmised to be as follows.

A rare earth ion is present in a grain boundary amorphous glass phase of a net structure and, when the current is supplied, the heat-generating resistor comes to have a high temperature and, then, the rare earth ion comes to be in a state in which it can move in a direction of an electric field within the grain boundary amorphous glass phase. When the number of the rare earth ions is large, the binding of the grain boundary amorphous glass phase is cut and, then, the rare earth ions are locally coagulated and many places are generated in which electric neutrality can no more be maintained. Thus, insulative failures are locally generated and an abnormal current flows. This abnormal current causes breakage of the heat-generating resistor, to thereby cause the electric conduction defect.

On the other hand, when the number of rare earth ions is small, the number of places in which the binding of the grain boundary amorphous glass phase is broken becomes small and, accordingly, the rare earth ions are not excessively accumulated. Therefore, local insulative failures are not generated and the voltage endurance is excellent.

Further, it is to be understood that the present invention is not limited to the specific embodiments thus disclosed above, and that embodiments modified in accordance with the object and application are intended to be included within the scope of the present invention.

INDUSTRIAL APPLICABILITY

According to a ceramic heater of the present invention, a heat-generating resistor comprises, as main components, silicon nitride, an electrically conductive compound and a grain boundary amorphous glass phase and, then, by allowing the amount of a rare earth element in terms of its oxide contained in this heat-generating resistor and the mole numbers of both the rare earth element and excess oxygen contained in this heat-generating resistor to be within the range specified by a relational formula expressed in terms of amounts of respective oxides thereof, electric conduction defect of the heat-generating resistor caused by a supplied current can be prevented, so that the ceramic heater is excellent in voltage endurance.

Further, according to a glow plug of the present invention, by being provided with the aforementioned ceramic heater, the ceramic heater also is excellent in voltage endurance.

The invention claimed is:

1. A ceramic heater, comprising an insulative ceramic base material and a heat-generating resistor embedded in the insulative ceramic base material, being characterized in that the heat-generating resistor comprises, as main components, silicon nitride, an electrically conductive compound and a grain boundary amorphous glass phase; the amount of a rare earth element contained in the heat-generating resistor is less than 2% mol in terms of its oxide ($RE_2O_3$; RE representing a rare earth element); and, when the mol number of the rare earth element in terms of its oxide is represented by A and the mol number of an amount of excess oxygen in terms of silicon dioxide ($SiO_2$) contained in the heat-generating resistor is represented by B, a ratio R computed by the following formula (1) is 0.3 or less:

$$R=A/(A+B) \quad (1).$$

2. The ceramic heater as set forth in claim 1, wherein the content of the electrically conductive compound in the heat-generating resistor is from 20 to 30% by volume.

3. The ceramic heater as set forth in claim 1, wherein the rare earth element oxide is $Er_2O_3$ and/or $Yb_2O_3$.

4. The ceramic heater as set forth in claim 1, wherein the electrically conductive compound is tungsten carbide and/or zirconium boride.

5. The ceramic heater as set forth in claim 4, wherein the content of the electrically conductive compound in the heat-generating resistor is from 20 to 30% by volume.

6. A glow plug, characterized by comprising the ceramic heater as set forth in claim 1.

7. The glow plug as set forth in claim 6, wherein the content of the electrically conductive compound in the heat-generating resistor is from 20 to 30% by volume.

8. The glow plug as set forth in claim 6, wherein the rare earth element oxide is $Er_2O_3$ and/or $Yb_2O_3$.

9. The glow plug as set forth in claim 6, wherein the electrically conductive compound is tungsten carbide or zirconium boride.

* * * * *